United States Patent [19]

Ragan

[11] 4,121,188

[45] Oct. 17, 1978

[54] CLOSED FRAME SINGLE TURN POTENTIOMETER WITH HELICAL COIL SPRING WIPER ADJUSTABLE THROUGH SUBSTRATE

[75] Inventor: Randall C. Ragan, Rancho Santa Fe, Calif.

[73] Assignee: North American Philips Corporation, New York, N.Y.

[21] Appl. No.: 723,932

[22] Filed: Sep. 16, 1976

Related U.S. Application Data

[63] Continuation-in-part of Ser. No. 642,328, Dec. 19, 1975, abandoned, which is a continuation-in-part of Ser. No. 452,130, Mar. 18, 1974, Pat. No. 3,964,011.

[51] Int. Cl.[2] ..... H01C 10/34

[52] U.S. Cl. ..... 338/174; 338/171; 338/202

[58] Field of Search ..... 338/174, 171, 157, 158, 338/202, 164, 184; 200/302

[56] References Cited

U.S. PATENT DOCUMENTS

| | | | |
|---|---|---|---|
| 2,717,944 | 9/1955 | Daily et al. | 338/174 X |
| 3,237,140 | 2/1966 | Barden et al. | 338/164 |
| 3,350,673 | 10/1976 | Spaude | 338/174 |
| 3,355,693 | 11/1967 | Van Benthuysen et al. | 338/174 X |
| 3,387,247 | 6/1968 | Mishler | 338/184 X |
| 3,392,359 | 7/1968 | Resnicow | 338/174 |
| 3,413,588 | 11/1968 | Ferrell | 338/174 |
| 3,531,753 | 9/1970 | Geese | 338/202 X |
| 3,537,056 | 10/1970 | Van Benthuysen et al. | 338/164 X |
| 3,662,314 | 5/1972 | Heredero | 338/174 X |
| 3,676,822 | 7/1972 | Slagg et al. | 338/174 X |

FOREIGN PATENT DOCUMENTS 1,415,842 11/1975 United Kingdom.

OTHER PUBLICATIONS

*Machine Design* Penton Publishing Co., Cleveland, Ohio, Sep. 9, 1971, pp. 72–74.

*Primary Examiner*—J. V. Truhe
*Assistant Examiner*—D. A. Tone
*Attorney, Agent, or Firm*—Frank R. Trifari; Daniel R. McGlynn

[57] ABSTRACT

A closed frame single turn potentiometer incorporating a helical coil spring wiper mounted within a rotor. The rotor has a molded-in cavity for containing the wiper and a resilient backing element. The substrate has an aperture therein permitting adjustment of the rotor from either side of the housing.

14 Claims, 6 Drawing Figures

Fig. 3
PRIOR ART
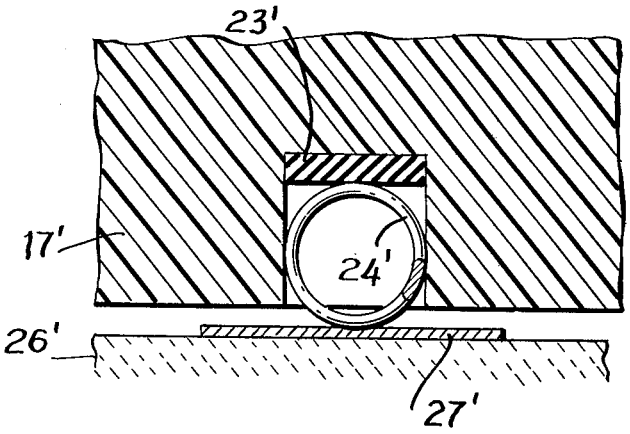
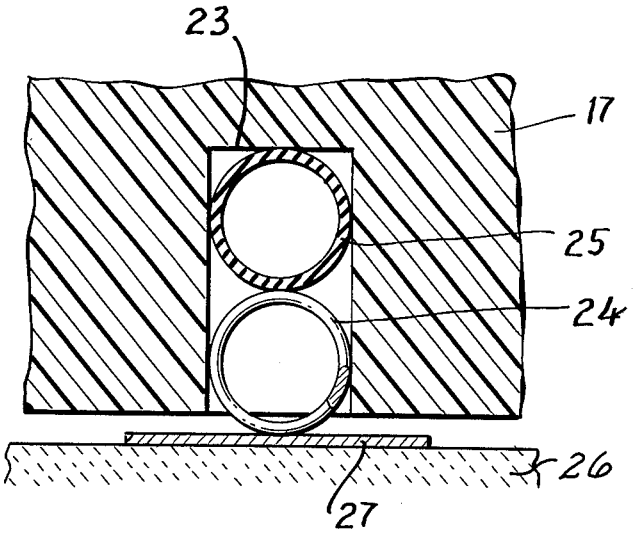
Fig. 4
Fig 5
PRIOR ART
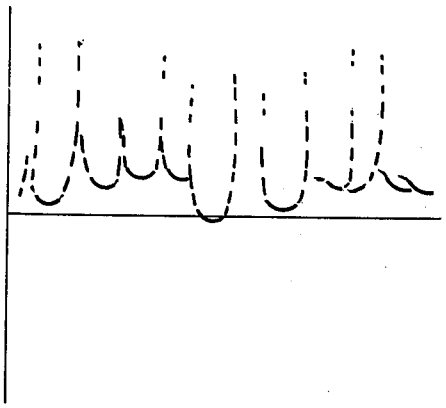
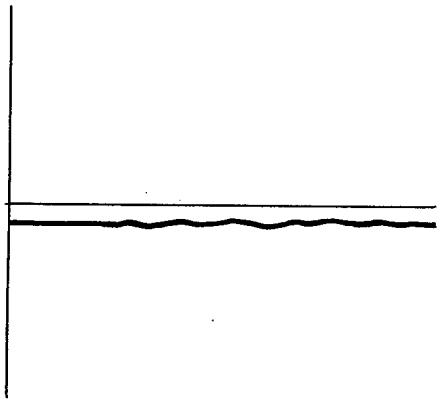
Fig. 6

CLOSED FRAME SINGLE TURN POTENTIOMETER WITH HELICAL COIL SPRING WIPER ADJUSTABLE THROUGH SUBSTRATE

REFERENCE TO RELATED APPLICATIONS

This application is a continuation-in-part of U.S. application Ser. No. 642,328, filed Dec. 19, 1975, now abandoned, but continued in Ser. No. 798,990, filed May 20, 1977. Ser. No. 642,328 is in turn a continuation-in-part of application Ser. No. 452,130, filed Mar. 18, 1974, now U.S. Pat. No. 3,964,011, both of which applications are hereby incorporated by reference.

FIELD OF THE INVENTION

This application relates to variable resistor devices such as potentiometers and, more particularly, small, compact and simply constructed single-turn potentiometers.

BACKGROUND OF THE INVENTION

Potentiometers incorporating helical coil spring wipers have been known in the prior art, as amply discussed in the related applications incorporated herein. Such helical coil spring wipers are placed in cavities containing an element formed of a resilient material. In U.S. Pat. No. 3,531,753 for example, the helical coil spring wiper both rolls and slides along the surface of the resistance element. The individual coil sections of the spring in fact effect multiple electrical contacts with the resistance element. As a result, the electrical connection is not a smooth one, and the contact resistance variation (CRV) was not suitable for highly accurate commercial use of such potentiometers.

SUMMARY OF THE INVENTION

It is the object of the invention to provide a closed frame single-turn potentiometer employing a miniaturized coil spring wiper with a resilient rubber backing for effecting a smooth wiping of a resistance element.

It is another object of the present invention to provide a closed-frame unit having a minimum number of parts to enable rapid and economical assembly of the unit.

It is an additional object of the present invention to affix a rotor to a potentiometer including a substrate element wherein the rotor is rotatable by means of adjustment through the substrate.

It is still another object of the present invention to provide a method of affixing a rotor to a substrate in a potentiometer which simultaneously improves the torque and contact resistance variation of the potentiometer.

Still another object of the present invention is the provision of a dust-free closed-frame unit having a built-in stop mechanism and a simplicity of assembly and construction.

Other objects of the present invention will become apparent by reference to the following description and drawings while the scope of the invention will be pointed out in the appended claims.

The present invention provides a variable resistance device including a substrate having an opening therein surrounded by a central collector ring and an arcuate resistance element. The device also includes terminal means on the substrate for connection to at least one end of the resistance element and the central collector ring.

A rotor having a shaft extending through the opening in the substrate and journalled to rotate therein is also provided in the device. The rotor includes a cavity containing a multiple contact wiper for making electrical contact between the collector ring and the arcuate resistance element.

BRIEF DESCRIPTION OF THE DRAWINGS

FIG. 3 is an enlarged cross sectional view of the rotor and substrate of the trimming potentiometer according to the prior art in the region of the cavity in the rotor containing the helical coil spring wiper;

FIG. 4 is an enlarged cross section view of the rotor and substrate of the trimming potentiometer according to the present invention in the region of the cavity in the rotor containing the helical coil spring wiper;

FIG. 5 is a graph of the contact resistance variation as a function of angle as the trimming potentiometer of the prior art design is adjusted to a set value;

FIG. 6 is a graph of the contact resistance variation as a function of angle as the trimming potentiometer according to the present invention is adjusted to a set value.

Turning now to FIG. 1, there is shown an exploded perspective view of the closed frame single turn potentiometer with a helical coil spring wiper as taught by the present invention. The closed frame housing 10, composed of synthetic plastic material, is basically rectangular in shape. It has a circular opening 11 in the front wall 12, a rectangular opening 13 (shown by dotted lines, the depth into the housing 10 being somewhat exaggerated for clarity) in the rear wall 14, and slits or lead openings 15 in one of the side walls 16.

Figure 1:
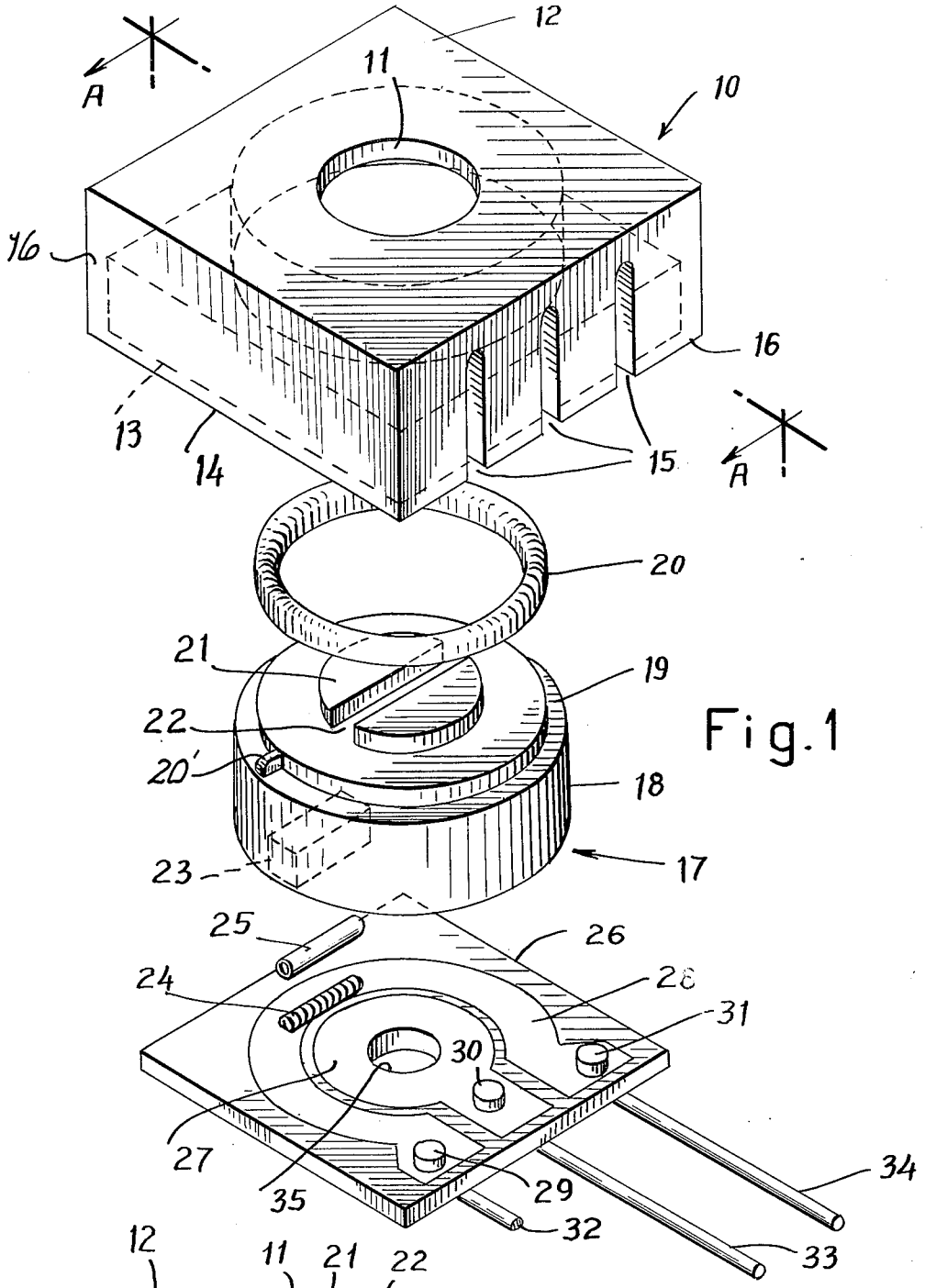
FIG. 1 is a perspective view of the closed frame single turn potentiometer according to the present invention.

The rotor 17 is also composed of synthetic plastic material, essentially cylindrical in shape, and includes a bearing surface 18 for rotatably engaging a corresponding surface (shown by the cylindrically-shaped dotted lines) in the interior of the housing 10. The rotor 17 includes a concentric annular ledge 19 adapted to receive a seal 20. The annular seal 20, composed of resilient material, with a "D" cross-section, is positioned to sit on the ledge 19 and contact the interior front wall 12 of the housing 10, thereby sealing the interior of the housing 10 for debris that may enter through the opening 11 in the front wall 12 of the housing 10. (The positioning of a cross-sectional slice 20' of the seal 20 is shown resting on the ledge 19).

The D ring seal 20 preforms three functions: it provides a spring action in the vertical direction between the rotor 17 and the housing 10, pressing the wiper 24 against the substrate 26. The D ring seal 20 also provides a means to control the turning torque as the rotor 17 is rotated with respect to the housing 10. And furthermore, the D ring seal 20 also provides a means for controlling the build-up in tolerences between the various component elements of the trimmer.

Previously known trimmers have been manufactured "edge-to-edge" between the rotor and the housing. This creates a number of disadvantages including relatively poor torque control. The seal 20 provides a seal against moisture, and from foreign materials entering into the potentiometer. The shape of the seal as a hemisphere of "D" ring is also believed to be unique. The flat surface facing the rotor side tends to grab against the slick plastic material regardless of the direction in which the rotor is turned. The rotor is also free to extend laterally under pressure in the radial direction. The D ring seal 20 is positioned on the ledge 19 so that the upper hemispherical portion of the seal 20 contacts the interior surface of the housing 10. Such contact against the flat interior surface of both the front wall 12 and the cylindrically-shaped corresponding surface (shown by dotted lines) provides a spring action both in horizontal (or radial) and the vertical (or axial) directions.

The D ring seal 20 also provices a means of controlling back lash during adjustment of the potentiometer. The rotor 17 also includes a top portion 21 which is substantially cylindrical in shape, and adapted to fit through the opening 11 in the front wall 12 of the housing 10. The top portion 21 includes a cavity or slot 22 which extends a predetermined distance into the interior of the rotor 17, and which is adapted for receiving a screw-driver head or other adjusting tool, to provide a means for turning the rotor 17 when it is placed in the housing 10. Also shown is a cavity 23 on the bottom portion of the rotor 17 adapted for receiving the helical coil spring wiper 24 and a cylindrically-shaped resilient backing tube 25.

Finally, there is shown the ceramic substrate 26 including a collector element 27, a resistance element 28, terminal pins 29, 30 and 31, which are attached to respective leads 32, 33 and 34. The substrate 26 may also be provided with a hole 35 concentric with the opening 11 on the housing for providing a means for rotating the rotor 17 through the rear portion of the housing 10, that is, through the hole 35 in the substrate 26.

Figure 2:
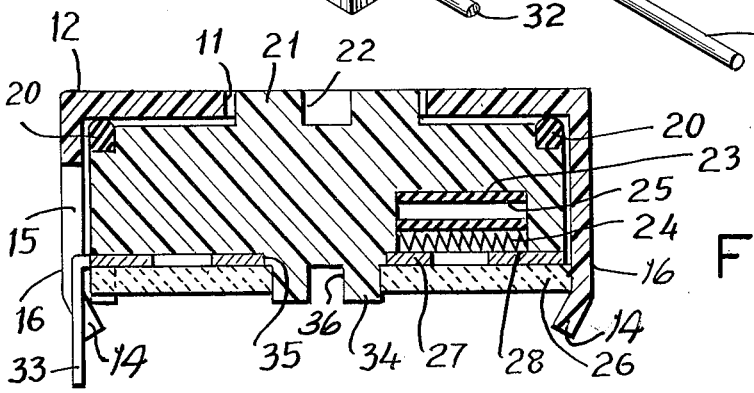
FIG. 2 is a cross sectional view of the assembled trimming potentiometer through the AA plane shown in FIG. 1.

FIG. 2 is a cross-sectional view of the trimming potentiometer according to the present invention through the AA plane shown in FIG. 1.

As shown in FIGS. 1 and 2, the slits or lead openings 15 enable the leads to be bent in any direction after emerging from the substrate 26. The leads may also be attached to either side of the substrate 26, as indicated by the two different positions of lead attachments shown in FIGS. 1 and 2 respectively. The leads are attached by thermal swaging or other methods known in the art.

The embodiment shown in FIG. 2 differs slightly from that of FIG. 1 in terms of the position of the leads 33, and the slot 22 with respect to the cavity 23.

FIG. 2 also shows a portion 34 of the rotor 17 which is journalled for rotation in the opening 35 of the substrate 26. This portion 34 provides a means for turning the rotor 17 from the back side of the potentiometer. The portion 34 includes a cavity or slot 36 adopted to receive a screw-driver or adjusting tool for turning the rotor 17.

Finally, FIG. 2 also illustrates that the end-portions 14 of the side walls 16 of the housing 10 may be bent inwardly for mechanically holding and securing the rotor 17 and substrate 26 within the housing 10. Other techniques, such as the use of a thermosetting resin covering a portion of the substrate may also be used.

FIG. 3 is a side sectional view of a portion of a single turn potentiometer known in the prior art, as represented by U.S. Pat. No. 3,531,753. The view shows the rotor portion 17', the ceramic substrate 26', the helical coil spring wiper 24', the resilient pad 23', and the collector 27'. As represented in the prior art, the resilient pad 23' is merely dimensioned so that the turns of the spring are pressed lightly into firm contact with the resistance element and with the collector. The configuration represented in FIG. 3, with a resilient pad having a thickness approximately one fifth the diameter of the helical coil spring wiper 24' is apparently suitable for the requirements of the prior art. Such a configuration, nevertheless, has unsatisfactory electrical characteristics due to the partly sliding and partly rolling motion of the helical spring wiper 24' against the collector 27'. Such uneven motion is due to the uneven force exerted by the resilient pad 23' on the surface of the helical coil wiper 24'. Applicant has provided a new and improved configuration shown in FIG. 4 to overcome these disadvantages of the prior art, and achieve superior torque control and reduced contact resistance variation (CRV).

FIG. 4 shows a portion of the helical spring wiper configuration in a single turn potentiometer according to the present invention. FIG. 4 shows the rotor portion 17, the ceramic substrate 26, and the collector 27. The resilient member 25 and the helical coil spring wiper 24 are located in a substantially deeper rectangular pocket or recess 23 than in the prior art. More significantly, the resilient pad 25 is not a rectangular solid as in the prior art, but a cylindrical tube 25 having a hollow portion therein. Applicant has found that by providing the resilient pad 25 in the form of either a solid or hollow cylindrical tube, better torque control and reduced contact resistance variation is achieved. The improvement is basically due to the distribution of force which the cylindrical tube enables. Upward motion or force from the spring 24 is now no longer directed to only the upper portion of the recess 23, but is further directed to the side portions of the recess 23, due to the cylindrical shape of the resilient member 25. This equalization of force around both the top and the side portions of the recess 23 enables the helical coil spring wiper 24 to move against the collector 27 in a better mechanical manner. The particular mechanical manner in which the helical coil spring wiper 24 moves against the collector 27 is a sliding, and not rolling, motion. It has been found that this sliding and not rolling motion, which cannot be produced with the prior art configuration of FIG. 3, has the improved and superior electrical characteristics noted above.

FIGS. 5 and 6 are oscilloscope tracings comparing the electrical characteristic of a helical coil spring wiper with a narrow, rectangular resilient pad, and with a wide cylindrical tube as a resilient pad, respectively.

FIGS. 5 and 6 are representations from oscilloscope tracings made from two substantially identical single-turn trimmer potentiometers, wherein the only distinguishing difference between the potentiometer is the type of resilient pad used. The particular experimental set up utilized two ¼-inch round trimmers, rated 100 ohms, and tested according to the specification of MIL-R-39035 A, using a Nicolet Digital Oscilliscope Model 1090. Both the signals represented in FIGS. 5 and 6 display the entire, unfiltered signal, with DC offset plus the contact resistance variation (CVR).

FIG. 5 is representation of an oscilloscope tracing in which the coil is free to move about 0.055 inch in its cavity, and would therefore slide and roll during movement of the rotor in a manner similar to the prior art. The contact resistance variation was measured with a standard measuring circuit including a constant current source, and an AC-amplifier applied to an oscilloscope. The operating shafts of potentiometers were rotated in both directions through 90° of the actual effective electrical travel for a total of 6 cycles, with only the last three cycles being used to determine the contact resistance variation observed. The rate of rotation of the operating shaft was such that the wiper completed one cycle in 5 seconds, minimum, to 2 minutes, maximum. The oscilloscope tracing is a measurement of such contact resistance variation when performing slight forward and back movements, such as one would use in coming to a predetermined value in the center of resistance travel. One should note the particularly large increase in contact resistance including several peaks to over 10%.

FIG. 6 is a representation of an oscilloscope tracing using a substantially identical trimmer potentiometer in the same measuring circuit of FIG. 5, but featuring the wide cylindrical tube as a resilient pad to completely restrain the coil from rotation as taught by the present invention. The same back and forth movements are imparted to the wiper as one would use in coming to a value in the center of resistance travel. It is noted that the peaks of contact resistance are substantially diminished compared to that in FIG. 5, and the CRV is limited to about 1% maximum. Such superior electrical characteristics and performance is believed to be a significant and useful improvement in the design of a helical coil spring wiper potentiometer compared with the prior art.

While the invention has been illustrated and described as emobdied in a Closed Frame Single Turn Potentiometer With Helical Coil Spring Wiper Adjustable Through Substrate, it is not intended to be limited to the details shown, since various modifications and structural changes may be made without departing in any way from the spirit of the present invention.

Without further analysis, the foregoing will so fully reveal the gist of the present invention that others can, by applying current knowledge adapt it for various applications without omitting features that, from the standpoint of prior art, fairly constitutes essential characteristics of the generic or specific aspects of this invention and, therefore, such adaptions should and are intended to be comprehended with the meaning and range of equivalence of the following claims.

What is claimed as new and desired to be protected by Letters Patent is set forth in the appended claims.

1. A single turn variable resistance device comprising:

a ceramic substrate having a central collector ring and an arcuate resistance element;

a housing having a front wall and side walls, said front wall having an opening therein; the inner portion of said housing having a first interior wall portion for receiving said substrate, a second interior wall portion surrounding said opening in said front wall, and a third interior wall portion intermediate said first and said second interior wall portions, a rotor in said housing having side walls engaging said third interior wall portion of said housing as a bearing surface, and including a helical coil spring wiper facing said substrate for making electrical contact between said collector ring and said resistance element, and a cylindrical resilient support contacting said wiper for biasing said wiper against said substrate; and means mechanically holding said substrate and said rotor in said housing.

2. The resistance device as defined in claim 1, wherein said rotor includes a recess in said rotor facing said resistance element and collector ring, said resilient support being inserted in said recess, and said wiper being inserted in said recess and pressed against said resistance element and said collector ring by said support.

3. The resistance device as defined in claim 1, wherein said substrate has an opening therein, said rotor including a portion extending through said opening for rotatable adjustment therethrough.

4. The resistance device as defined in claim 1, wherein said resilient support is a hollow cylindrical tube.

5. A single turn variable resistance device comprising:

a ceramic substrate having an opening therein, said substrate having a central collector ring and an arcuate resistance element;

terminal means on said substrate in connection to at least one end of said resistance element and said central collector ring;

a substantially rectangular housing having a front wall and side walls, said front wall having an opening therein, the inner portion of said housing having walls bounding a cylindrical recess;

a rotor in said housing having a first portion extending into said opening of said front wall of said housing;

a second portion of said rotor being journalled for rotation in said cylindrical recess of said housing;

a third portion of said rotor extending into the opening of said substrate and being journalled for rotation therein; said rotor including a helical coil spring wiper facing said substrate for making electrical contact between said collector ring and said resistance element, and a cylindrical resilient support contacting said wiper for biasing said wiper against said substrate; and means mechanically holding said substrate and rotor in said housing.

6. The device of claim 5, further comprising conductor leads affixed to said terminal means, and extending from said housing.

7. The device of claim 6, wherein each of said conductor leads is thermally swaged to said corresponding terminal means.

8. The resistance device as defined in claim 5, wherein said rotor includes a recess in said rotor facing said resistance element and collector ring; said resilient support being inserted in said recess; said wiper also inserted in said recess and pressed against said resistance element and said collector ring by said support.

9. The resistance device as defined in claim 8, wherein said resilient support is a hollow cylindrical tube.

10. The resistance device as defined in claim 5, wherein said rotor includes adjustment means, engagable with an adjustment tool, accessible through said opening in said front wall.

11. The resistance device as defined in claim 5, wherein said rotor includes a shoulder aligning with a corresponding shoulder on the interior portion of said front wall of said housing; and further comprising sealing means located between said shoulder on said rotor and said shoulder in said housing for sealing said device.

12. The resistance device as defined in claim 11, wherein said sealing means is a ring having a hemispherical cross-section, composed of a resilient synthetic plastic material, and circumferentially surrounding said opening in said front wall of said housing.

13. The resistance device as defined in claim 5, wherein said rotor includes a shoulder aligning with a corresponding interior wall portion of said housing; and further comprising spring means located between said shoulder on said rotor and said wall portion of said housing for pressing said rotor against said substrate.

14. The resistance device as defined in claim 13, wherein said spring means is an annular member having a hemispherical cross-section, and composed of a resilient synthetic plastic material.

* * * * *